US010101699B2

(12) United States Patent
Uchida

(10) Patent No.: US 10,101,699 B2
(45) Date of Patent: Oct. 16, 2018

(54) IMAGE FORMING APPARATUS AND IMAGE QUALITY ADJUSTING METHOD

(71) Applicant: Sharp Kabushiki Kaisha, Sakai, Osaka (JP)

(72) Inventor: Hirohisa Uchida, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 15/489,795

(22) Filed: Apr. 18, 2017

(65) Prior Publication Data

US 2017/0308018 A1 Oct. 26, 2017

(30) Foreign Application Priority Data

Apr. 22, 2016 (JP) ..... 2016-086469

(51) Int. Cl.
*G03G 15/00* (2006.01)

(52) U.S. Cl.
CPC ..... *G03G 15/5058* (2013.01); *G03G 15/5041* (2013.01); *G03G 15/5008* (2013.01); *G03G 15/5033* (2013.01); *G03G 2215/00075* (2013.01)

(58) Field of Classification Search
USPC ..... 399/38, 42, 49, 72, 74
See application file for complete search history.

(56) References Cited

U.S. PATENT DOCUMENTS 7,693,468 B2 * 4/2010 Ehara ..... G03G 15/0131 399/301
8,831,449 B2 * 9/2014 Suzuki ..... G03G 15/0189 399/49
2012/0274986 A1 11/2012 Harashima et al.

FOREIGN PATENT DOCUMENTS

JP 2012-230312 A 11/2012

* cited by examiner

*Primary Examiner* — Hoan Tran
(74) *Attorney, Agent, or Firm* — Keating & Bennett, LLP

(57) ABSTRACT

An image forming apparatus includes: a density unevenness measurement mode processing portion that, in a density unevenness measurement process, detects density of a density unevenness measurement toner image, which has been formed in a rotational direction of the photoreceptor drum, multiple times in the rotational direction and captures in a memory portion all detected density information associating thereof with rotation phases of the photoreceptor drum; and an image quality adjustment processing portion that, in an image quality adjustment mode, detects density of an image quality adjustment toner image, which has been formed at any position in the rotational direction of the photoreceptor drum, in the rotational direction and corrects detected density information based on density information associated with a rotation phase matching a rotation phase where density of the image quality adjustment toner image has been detected among said all density information having been captured in the memory portion by the density unevenness measurement processing portion.

7 Claims, 8 Drawing Sheets

| Rotation phase | φ1 | ・・・ | φi | ・・・ | φn |
|---|---|---|---|---|---|
| Density information | Dg1 | ・・・ | Dgi | ・・・ | Dgn |

IMAGE FORMING APPARATUS AND IMAGE QUALITY ADJUSTING METHOD

CROSS REFERENCE

This Nonprovisional application claims priority under 35 U.S.C. § 119(a) on Patent Application No. 2016-086469 filed in Japan on Apr. 22, 2016, the entire contents of which are hereby incorporated by reference.

BACKGROUND OF THE INVENTION

The present invention relates to an image forming apparatus such as copier, multi-functional apparatus, laser printer, facsimile and so forth that performs image forming according to the electrophotography method, and to an image quality adjusting method.

In an image forming apparatus, density of a toner image that is deposited onto a revolving image bearing member may change caused by a change of environment such as temperature and/or humidity, and/or a change over time and so forth. Therefore, where necessary, density adjustment for a gradation correction is performed by carrying out a process control, that is, by forming a test pattern consisting of multiple patches sequentially in different levels of toner density on the image bearing member. More specifically, the process includes detecting the levels of density of the test patches formed on the image bearing member, and changing the image forming conditions such as developing bias and/or the like based on the detected values so that the levels of density agrees with an ideal gradation characteristic.

On the other hand, facing a revolving surface of the image bearing member, the image bearing member, together with an electrostatic charging portion to perform electrostatic charging, a laser exposure portion to form an electrostatic latent image, a developing portion to render the electrostatic latent image manifest by depositing thereto a toner and so forth, constitutes an image forming portion. If mechanical misalignment or a change such as eccentricity and/or the like occurs in a revolving shaft of the image bearing member, distance from the surface of the image bearing member changes in a sub-scanning direction which is rotational direction, and thus unevenness may occur in electrostatic charging characteristics, amount of laser light and toner deposition characteristics. Such mechanical misalignment or a change results in a change of toner deposition amount that is finally deposited onto the image bearing member, thereby lowering the reproducibility of images.

JP 2012-230312A describes an image forming apparatus in which a toner pattern is formed as a preprocessing on a circumferential surface of the image bearing member and, based on the result detected on period or the like of the toner pattern, a period with which a maximum amount of density change appears is determined and, based on the determination result, an arrangement of patches at the time of process control is decided to thereby offset the effect of the density change.

However, in the image forming apparatus described in JP 2012-230312A, it is necessary to decide the arrangement of the patches on the image bearing member depending on the period which is the determination result, and thus, at the time of an image quality adjustment, it is necessary to wait until the position decided on the image bearing member revolves to come to a position that is faced by the density sensor; therefore, there is a problem that doing so takes a time. Accordingly, the time needed to perform an entire image quality adjustment becomes longer. Moreover, in the case of color, because there are four colors, for each of which it is necessary to adjust a phase, the time needed to perform an overall positional adjustment cannot be ignored. Besides, because the image bearing member has to be revolved more to that extent, there is also a problem that its service life becomes shortened.

SUMMARY OF THE INVENTION

It is an object of the present invention to provide an image forming apparatus and an image quality adjusting method capable of quickly correcting the effect of density unevenness in a rotational direction of an image bearing member.

An image forming apparatus according to the present invention, in which a toner image is formed onto a revolving image bearing member, includes a density unevenness measurement processing portion, and an image quality adjustment processing portion. The density unevenness measurement processing portion detects density of a density unevenness measurement toner image, which has been formed in a rotational direction of the image bearing member, multiple times in the rotational direction, and captures in a memory portion detected density information associating thereof with rotation phases of the image bearing member. The image quality adjustment processing portion detects density of an image quality adjustment toner image, which has been formed at any position in the rotational direction of the image bearing member, in the rotational direction, and corrects detected density information based on density information that is associated with a rotation phase that matches a rotation phase at which density of the image quality adjustment toner image has been detected among said density information that has been captured in the memory portion by the density unevenness measurement processing portion.

Also, an image quality adjusting method according to the present invention includes a density unevenness measurement step, and an image quality adjustment step. The density unevenness measurement step forms a density unevenness measurement toner image in a rotational direction of an image bearing member, detects, multiple times in the rotational direction, density of the density unevenness measurement toner image that has been formed, and captures in a memory portion detected density information associating thereof with rotation phases of the image bearing member. The image quality adjustment step forms an image quality adjustment toner image at any position in the rotational direction of the image bearing member, detects, in the rotational direction, density of the image quality adjustment toner image that has been formed, and corrects detected density information based on density information that is associated with a rotation phase that matches a rotation phase at which density of the image quality adjustment toner image has been detected among said density information that has been captured in the memory portion in the density unevenness measurement step.

According to these inventions, at the time when the image bearing member was mounted (including replaced and mounted again) onto the apparatus main body, all density information in the sub-scanning direction which is the rotational direction of the image bearing member is detected being associated with the rotation phase of the image bearing member, and detected density information is stored beforehand in the memory portion being associated with the rotation phase of the image bearing member. Subsequently, at the time of the image quality adjustment, the image quality adjustment toner image is formed at any position in the rotational direction of the image bearing member with a quick timing, that is, without waiting for a specific rotation phase position to come, and density of the image quality adjustment toner image that has been formed is detected at the rotation phase. Then, the density of the image quality adjustment toner image that has been detected is corrected based on the density information that is associated with a rotation phase that matches a rotation phase at which the density of the image quality adjustment toner image has been detected among said density information that has been captured in the memory portion. Therefore, the present invention makes it possible to quickly correct the density unevenness in the sub-scanning direction of the image bearing member with a less toner consumption, and to further perform the image quality adjustment with higher accuracy.

DETAILED DESCRIPTION OF THE EMBODIMENTS

Figure 1:
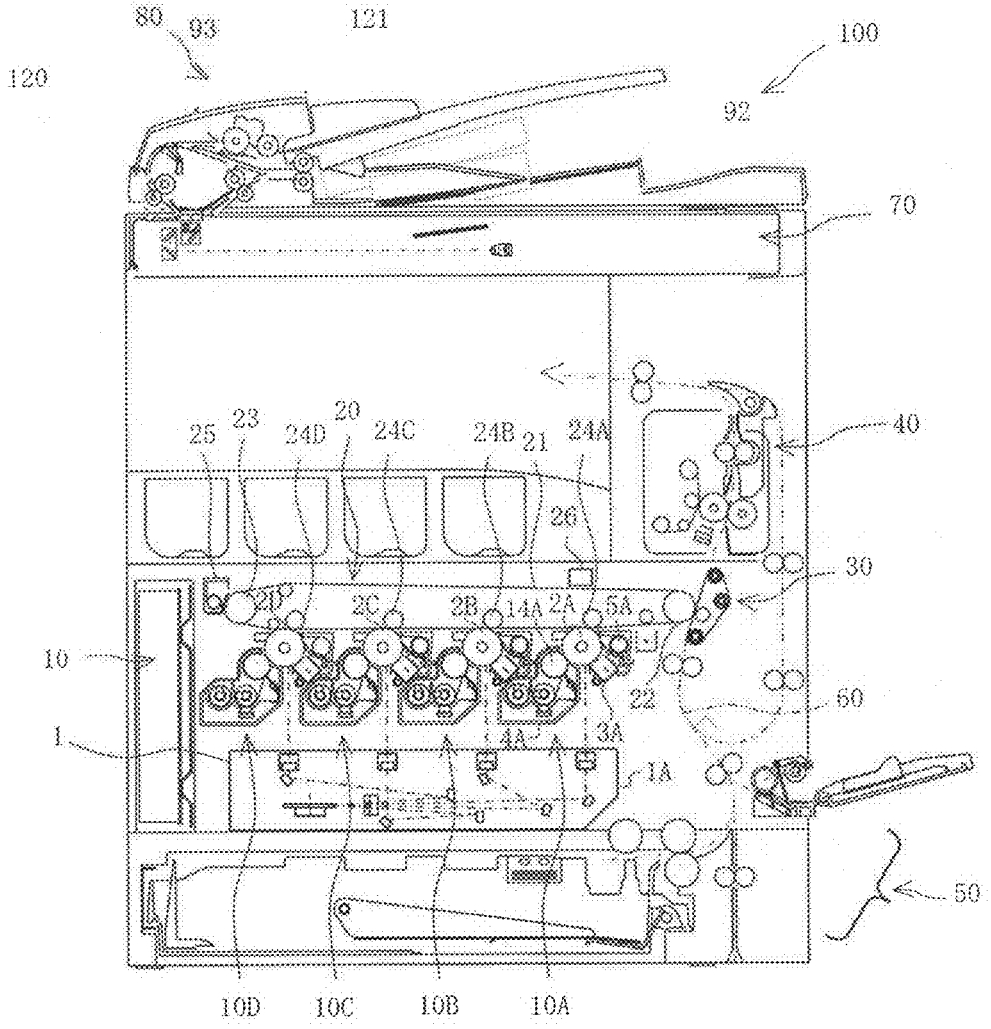
FIG. 1 is an illustration showing an overall structure of an image forming apparatus according to a first embodiment of the present invention.

As shown in FIG. 1, an image forming apparatus 100 includes an image forming portion 10, an intermediate transfer portion 20, a secondary transfer portion 30, a fixing portion 40, a paper feed portion 50, a paper conveyance path 60 and a reading portion 70, and is provided with an automated document feeder 80 in an upper part of an apparatus main body. The image forming apparatus 100 performs an image forming process onto a paper sheet either in color or in monochrome based on color or monochromatic image data that are either read through the reading portion 70 or inputted from an external device not shown.

The image forming portion 10 includes a light beam scanning unit 1, and image forming portions 10A-10D for respective colors that are similarly structured between each other. The light beam scanning unit 1 includes a semiconductor laser, and converts image data of respective pixels for colors R, G, B corresponding to a color document that has been read at the reading portion 70 into density data of black (K), cyan (C), magenta (M) and yellow (Y), and further through a gradation table that sets an input-output characteristic or the like, generates a laser light that has been modulated by a duty ratio corresponding to each of the density data. Each of electrostatic latent images is formed by the laser light that is scanned for exposure on each of surfaces of photoreceptor drums 2A-2D of the image forming portions 10A-10D along each of shaft directions (main scanning directions). The image forming portion 10A, being explained as typical, includes a photoreceptor drum 2A as image bearing member, and, around thereof, an electrostatic charger 3A, a developing unit 4A and a cleaner portion 5A along a rotational direction (sub-scanning direction). The photoreceptor drums 2A-2D and the developing rollers which are parts of the developing units 4A-4D and magnetic rollers facing the photoreceptor drums 2A-2D, respectively (in FIG. 1, the developing roller 14A of the developing unit 4A is illustrated), are rotationally driven, either synchronously or separately, by an image formation driving portion 131 (see FIG. 2) consisting of a motor, a clutch and a driving force transmission mechanism (such as gear). Besides, the intermediate transfer portion 20 and so forth are also synchronously driven either by the image formation driving portion 131 or by another driving source (such as motor).

The intermediate transfer portion 20 includes an intermediate transfer belt 21, a driving roller 22, an idle roller 23, and primary transfer rollers 24A-24D, and, performs a primary transfer of toner images that have been formed on circumferential surfaces of the photoreceptor drums 2A-2D, respectively, onto a surface of the intermediate transfer belt 21 as image bearing member. The secondary transfer portion 30 performs a secondary transfer of a toner image on the surface of the intermediate transfer belt 21 onto a recording paper sheet. The fixing portion heats and thereby fixes the toner image that has been transferred onto the recording paper sheet, and discharge the paper sheet onto a paper receiving tray. The paper feed portion 50 includes a paper feed cassette and a manual feed tray, and feeds a selected recording paper sheet from a corresponding paper feed cassette to the paper conveyance path 60.

Figure 3:
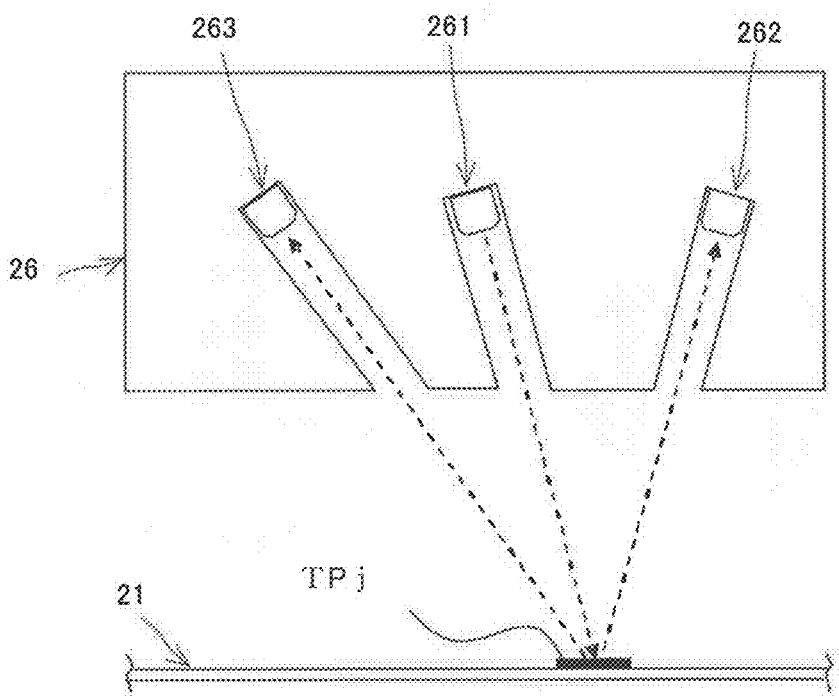
FIG. 3 is a schematic block diagram of a density sensor.

In this embodiment, a density sensor 26 is disposed in such a manner as to face the surface of the belt at an appropriate position in a circulating range of the intermediate transfer belt 21. The density sensor 26, as shown in FIG. 3, includes: a light-emitting device 261 that emits light toward the intermediate transfer belt 21; a regular reflection photodetector 262 that receives light regularly reflected from the toner image which has been produced and transferred onto the intermediate transfer belt 21 in a density unevenness measurement mode or an image quality adjustment mode as described later, for example, a density unevenness measurement toner image or test patches (image quality adjustment toner image) as will be described later and outputs a voltage depending on an amount of the received light; and an irregular reflection photodetector 263 that receives light irregularly reflected from the toner image and outputs a voltage depending on an amount of the received light. That is to say, the density sensor 26 outputs a level of voltage that depends on the toner density. Further, the density sensor 26 detects the density of the toner image that has been transferred from the photoreceptor drums 2A-2D onto the intermediate transfer belt 21 and moved to a position for the detection by the density sensor 26.

Figure 2:
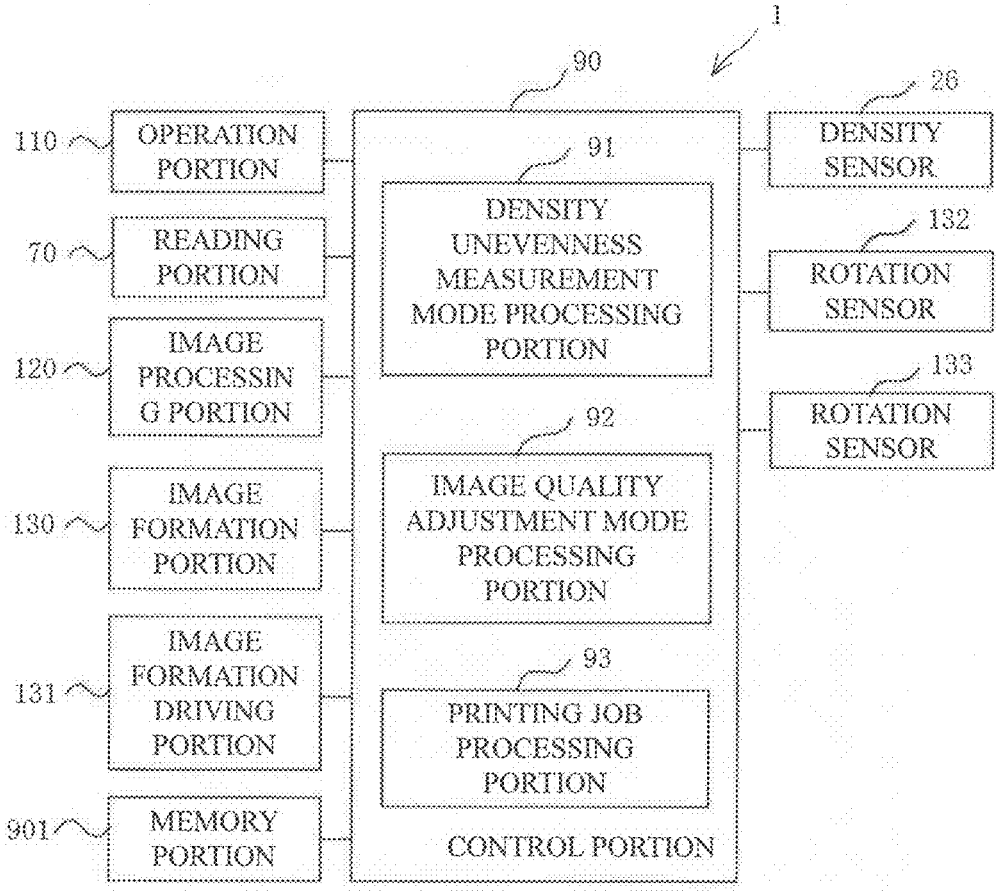
FIG. 2 is a block diagram of the image forming apparatus.

The image forming apparatus 100, as shown in FIG. 2, includes a control portion 90 consisting of a computer. The control portion 90 is connected to an operation portion 110 such as touch panel that accepts an operation from outside, the reading portion 70, an image processing portion 120 consisting of a circuit for processing the image data into printing data and so forth, an image formation portion 130 including the image forming portion 10 and the transfer system etc., and the image formation driving portion 131. Also, the control portion 90 is connected to a memory portion 901, the density sensor 26 and a rotation sensor 132. Still, a rotation sensor 133 will be described later. The memory portion 901 stores all sorts of programs needed to perform the density unevenness measurement mode and the image quality adjustment mode that are described later, as well as the printing job process, and all sorts of necessary data. Also, the memory portion 901 stores the information detected in each mode, information calculated using the detected result, as well as the gradation table and so forth.

The rotation sensor 132 may be provided at either each or any one of the revolving shafts of the photoreceptor drums 2, and may consist of a rotary encoder, for example. The rotation sensor 132 is one that generates a reference pulse when detecting the passage of a reference position in the circumferential direction of the photoreceptor drum 2, and the one that generates a rotation pulse each time the photoreceptor drum 2 revolves by a predetermined angle. The rotation sensor 132 detects a rotation phase of the photoreceptor drum 2 in real time using rotation phase information consisting of the reference pulse and the rotation pulse. Still, it may be acceptable as another embodiment that the rotation sensor 132 is configured to output (trigger) only the reference pulse, and that the rotation pulse is produced either using the drive signal (specifically, motor drive signal) to the image formation driving portion 131 or using the clock pulse inside the control portion 90.

The control portion 90 functions as a density unevenness measurement mode processing portion 91, an image quality adjustment mode processing portion 92 and a printing job processing portion 93, when a control program stored in the memory portion 901 is executed. Here, for convenience of description, regarding the control portion 90, functional parts that are related to the present invention are mainly shown. The printing job processing portion 93 accepts a printing job instruction from the operation portion 110, and, through the image processing portion 120 and the image formation portion 130, performs a series of operations including converting a print target image into a printing image, transferring and fixing the printing image onto a delivered recording paper sheet, and discharging the printed recording paper sheet.

The density unevenness measurement mode processing portion 91 forms a density unevenness measurement toner image Gt (see FIG. 4) in the rotational direction of the photoreceptor drum 2, that is, in the sub-scanning direction, preferably by at least a single complete revolution, and detects toner deposition amounts of the density unevenness measurement toner image Gt at a plurality of rotation phase positions in the rotational direction using the density sensor 26. The density unevenness measurement mode processing portion 91 is one that captures, from each detected result, density information in the circumferential direction associating thereof with the rotation phase. The density unevenness measurement mode process is explained using FIGS. 4-6.

The density unevenness measurement mode process is one that is performed as a preprocessing, and is carried out at least at the time of replacement, for example, mounting and/or reinstallation, of the photoreceptor drum 2. That is to say, even when a small deviation (phase shift and/or shaft misalignment) occurs between the photoreceptor drum 2 and peripheral members thereof resulting from the former's replacement or the like, and hence even when the relationship between the phase and the density unevenness changes, carrying out the density unevenness measurement mode process beforehand makes it possible to perform a density unevenness correction to detected density of the test patches (image quality adjustment toner image) that is obtained in the subsequent process carried out by the image quality adjustment mode processing portion 92, as will be described later.

Additionally, in this embodiment, the apparatus is configured in such a manner that the density unevenness measurement toner image Gt formed on the photoreceptor drum 2 is transferred onto the intermediate transfer belt 21 and there detected by the density sensor 26. Since the photoreceptor drum 2 revolves with the rotation phase thereof being monitored, even when the formation of the density unevenness measurement toner image Gt is started either at any time or at a preset time, it is possible to associate the density unevenness measurement toner image Gt with the rotation phase of the photoreceptor drum 2. That is to say, the toner deposition amount data of the density unevenness measurement toner image Gt that are detected by the density sensor 26 can be obtained being associated with the rotation phase information.

Figure 4:
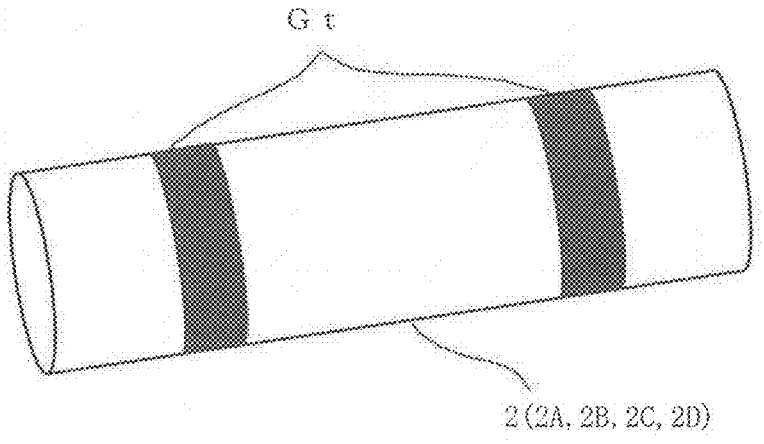
FIG. 4 is a perspective view of a photoreceptor drum in a state where thereon a density unevenness measurement toner image is formed.

The density unevenness measurement mode process forms the density unevenness measurement toner image Gt which is a belt-shaped toner image having a predetermined width and uniform density around a single complete revolution in the rotational direction, with the photoreceptor drum 2 being revolved at a constant rate. FIG. 4 shows this state, and in this embodiment, in order to suppress the density unevenness on both right and left sides, the density unevenness measurement toner images Gt are formed with a single column on either side. The right and left density unevenness measurement toner images Gt are detected by a pair of right and left density sensors 26, respectively. A set density value to form the density unevenness measurement toner image Gt is determined beforehand. The set density value is preferably at a level by which the density unevenness can be extracted highly noticeably, for example, at a level of intermediate density.

Figures 5A, 5B:
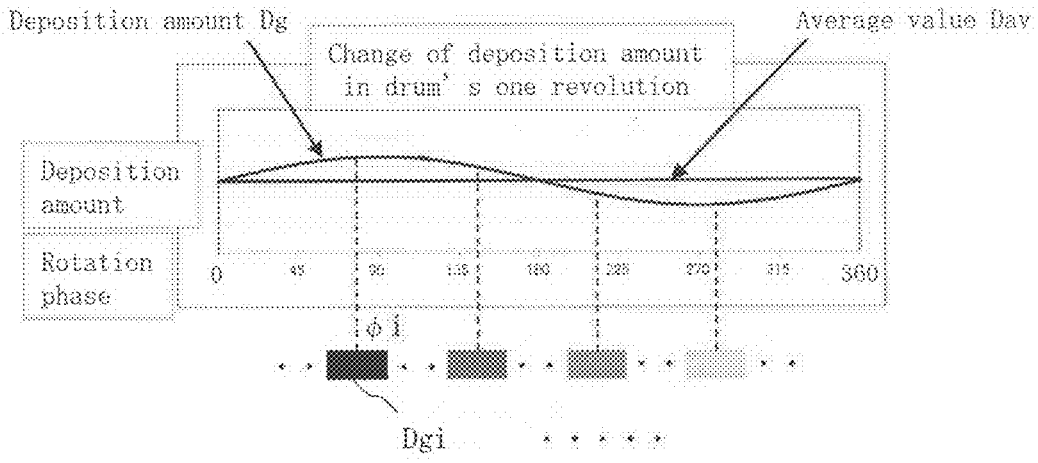
FIG. 5A is a diagram explaining an example of change of deposition amount of the density unevenness measurement toner image, and is a diagram showing an example of a characteristic in terms of deposition amount (density unevenness) vs. rotation phase of a photoreceptor drum.
FIG. 5B is a diagram explaining an example of change of deposition amount of the density unevenness measurement toner image, and is a memory map showing an example of storage with the density unevenness and the rotation phase being associated with each other.

The density sensor 26 detects the density of the density unevenness measurement toner image Gt that has been transferred and conveyed. FIG. 5A shows an example of change of the deposition amount for a single complete revolution of the photoreceptor drum 2, where density Dgi is detected at predetermined intervals associated with the rotation phase φi (0°-360°). Then, as shown in FIG. 5B, the rotation phase φi and the density Dgi are stored in the memory portion 901 being associated with each other. Here, the rotation phase φi is a predetermined angular pitch. Further, the density unevenness measurement toner image Gt is not necessarily a continuous belt-shaped toner image as long as its density unevenness for a single complete revolution of the photoreceptor drum 2 is measurable, but may be embodied in such a manner as to provide multiple patches discretely in the rotational direction, for example. Also, the density unevenness illustrated in FIG. 5A shows a state of its change occurring sinusoidally from the rotation phase 0° over to one period. Multiple marks Dgi shown at the lower part of FIG. 5A and indicating degrees of shading are those which are intended to explain levels of density that correspond to the density unevenness.

Figure 6:
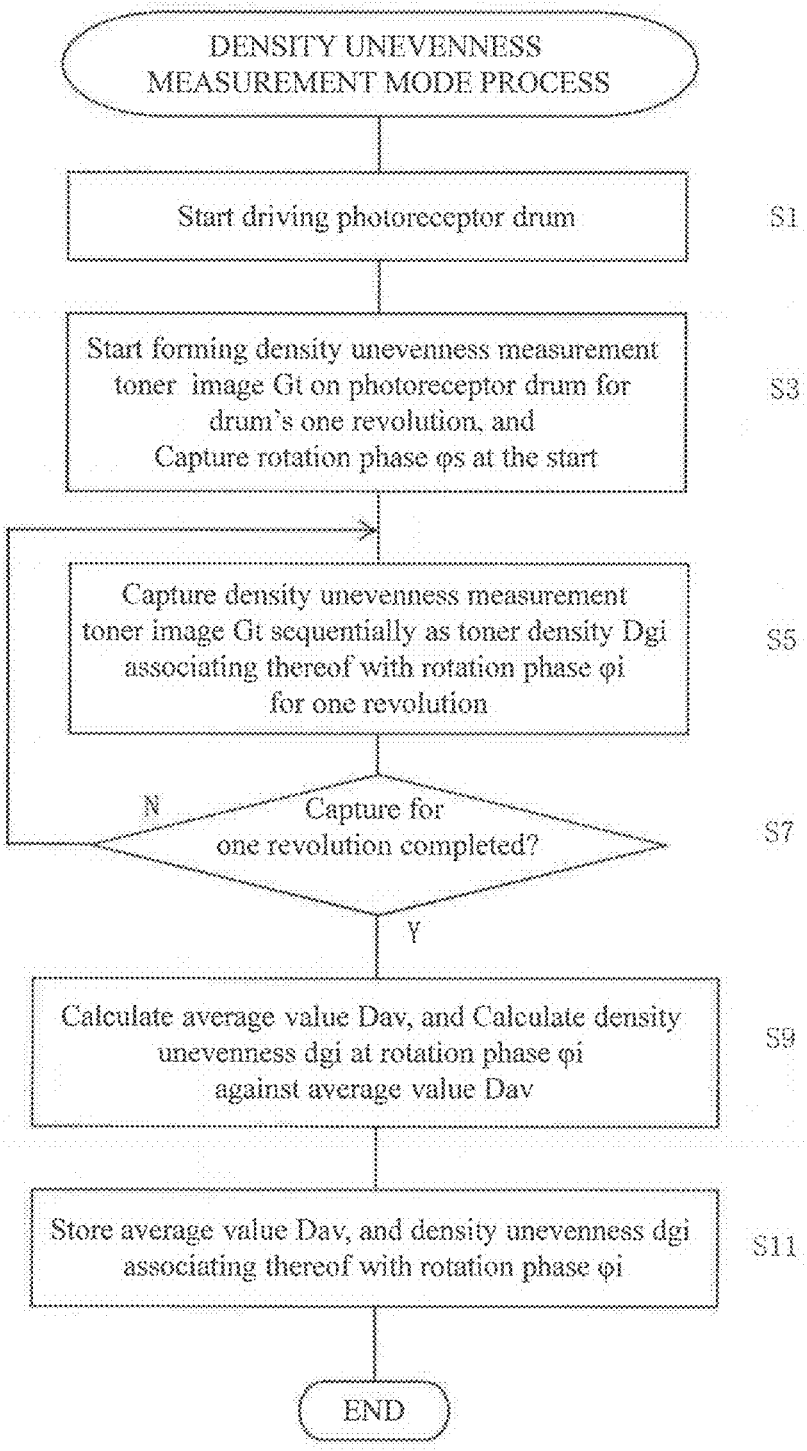
FIG. 6 is a flow chart showing a processing procedure in a density unevenness measurement mode.

Using the flow chart of FIG. 6, the density unevenness measurement mode process is explained. First, the image formation driving portion 131 starts up, and then driving the photoreceptor drum 2 and so forth is started (step S1). Subsequently, when formation of the density unevenness measurement toner image Gt for a single complete revolution is started while monitoring operation of the rotation phase is performed, the rotation phase φs of the photoreceptor drum 2 at the start of the formation is acquired (step S3). Detection of the single complete revolution of the photoreceptor drum 2 is performed by means of the rotation phase φ, for example. Next, using the density sensor 26, capture of the toner density Dgi of the density unevenness measurement toner image Gt is performed sequentially for each predetermined rotation phase φi in the rotational direction (step S5).

Then, when the capture over the single complete revolution is completed (Yes at step S7), subsequently, calculation of an average value Dav of the acquired toner density Dgi is performed; and then the density information Dgi for each rotation phase φi, here, density unevenness dgi for each rotation phase φi against the average value Dav, is calculated (step S9). Next, the calculated average value Dav and each density unevenness dgi are stored in the memory portion 901 (step S11). As the density unevenness dgi, a differential of the density Dgi from the average value Dav that is expressed in ratio or the like is used, for example. Still, the density unevenness is not limited to the ratio, but may be expressed by the differential itself or in other manners. Further, instead of the density unevenness dgi, as shown in FIG. 5B, the density information Dgi may be stored in the memory portion 901 as it is, in another embodiment. In such a case, the density unevenness information dgi may be calculated in the undermentioned image quality adjustment mode.

Adjustment of the toner density is carried out, in cases where the toner characteristic has changed due to changes of temperature and/or humidity and/or a change over time, as a process control procedure to correct the change. The image quality adjustment mode processing portion 92 performs a correction process to automatically adjust the toner density, input-output characteristic and/or the like to a preset ideal gradation characteristic, upon receipt of an instruction from the operation portion 110, or with a predetermined timing such as at every start up or for every predetermined number of printed paper sheets, or at the time when the changes of temperature and/or humidity exceed threshold values.

The image quality adjustment mode process is one that forms the test patch toner image of predetermined density for image quality adjustment, for example by just one toner image, at a predetermined short time width in the rotational direction of the photoreceptor drum 2 on receiving the instruction to perform the image quality adjustment mode while the photoreceptor drum 2 is revolved at a constant rate, and the one that detects the density of the test patch toner image using the density sensor 26.

The image quality adjustment mode processing portion 92 detects the rotation phase φj of the photoreceptor drum 2 at the time when the test patch toner image is formed, and then performs an undermentioned process in order to remove the effect of the density unevenness in the rotational direction of the photoreceptor drum 2. This process extracts (reads out) the density unevenness dgj of the density unevenness measurement toner image Gt that is synchronous (agrees) in the rotational direction with the rotation phase φj of the density Dtp of the test patch toner image, and then corrects the density Dtp using the density unevenness dgj. Calculation for the correction may be, for example, (Dtp/dgj).

Figure 7:
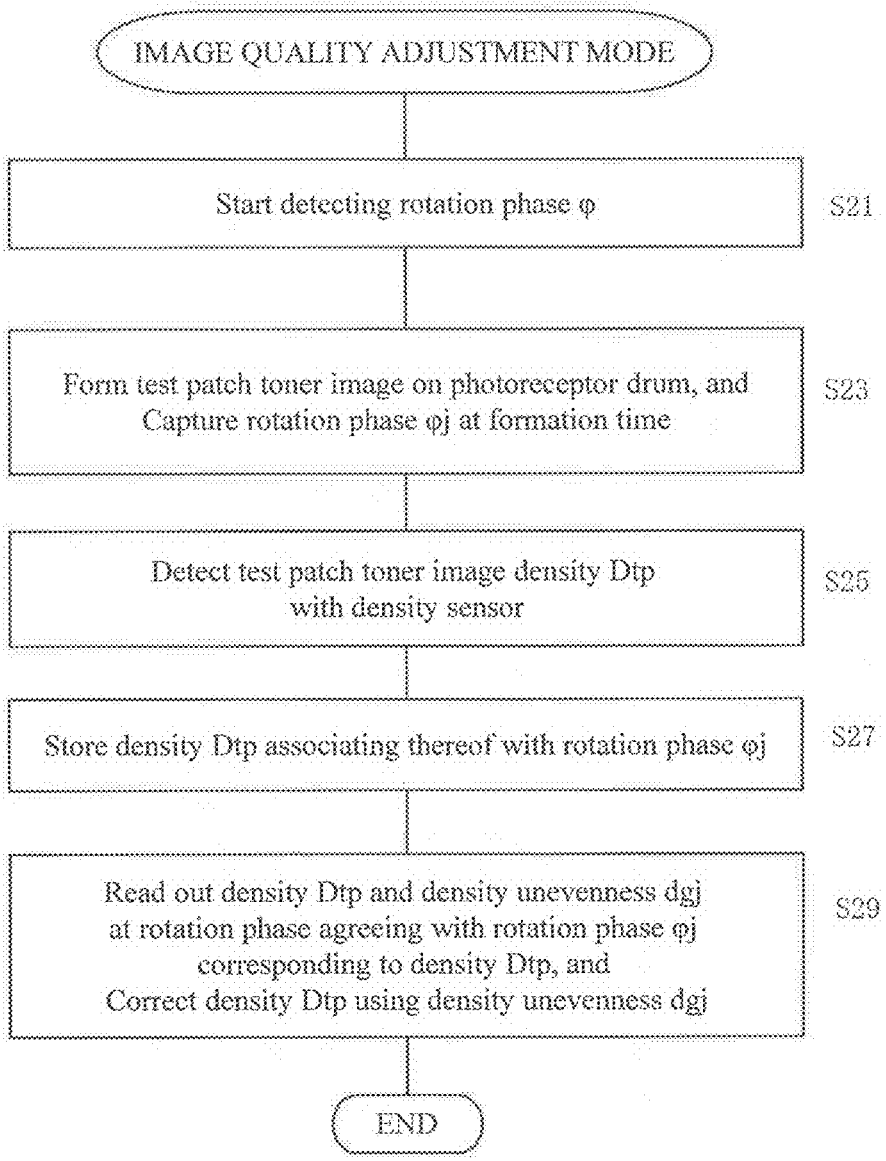
FIG. 7 is a flow chart showing a processing procedure in an image quality adjustment mode.

Using the flow chart of FIG. 7, the image quality adjustment mode process is explained. First, the image formation driving portion 131 starts up, and then the image formation portion 130 and so forth is driven. In this state, detection operation of the rotation phase φ is started (step S21). Subsequently, when the formation of the test patch toner image is carried out at any position in the rotational direction of the photoreceptor drum 2 while the monitoring operation of the rotation phase is performed, the rotation phase φj of the photoreceptor drum 2 at the time of the formation is acquired (step S23). Next, the density Dtp of the test patch toner image is detected by the density sensor 26 (step S25), and the density Dtp is stored being associated with the rotation phase φj (step S27).

Subsequently, the density unevenness correction is carried out. That is to say, the density Dtp and the density unevenness dgj at a rotation phase that agrees with the rotation phase φj corresponding to the density Dtp are read out, and then the density Dtp is corrected using the density unevenness dgj (step S29). In other words, the density Dtp is divided by the density unevenness dgj (Dtp/dgj). Through such a correction process, since the effect of the density unevenness in the rotational direction of the photoreceptor drum 2 is removed and thus correct density of the test patch toner image can be obtained, it is made possible to perform a highly accurate image quality adjustment. Here, the number of the test patch toner images may be either one or more in the rotational direction. In the case of multiple number, similarly detecting the rotation phase of each test patch toner image and performing the density unevenness correction synchronizing thereof with each rotation phase is just what is to be done.

Moreover, the image quality adjustment mode may be a gradation adjustment, or both of these may be included. The gradation adjustment, as is well known, is one in the process control that forms preset multiple kinds of patches sequentially in the rotational direction of the photoreceptor drum 2, and the one that from the density of each patch detected using the density sensor 26 corrects the gradation table of input-output signals. In this case as well, by detecting the rotation phase at the time when each patch is formed, and by capturing the rotation phase and the detected density information with both thereof being associated with each other, it is made possible in the image quality adjustment mode to perform density correction against the rotation phase.

Here, the density unevenness measurement mode process is not limited to one time, but can be carried out whenever necessary. In such cases after the first time, it is preferable to use, as the average value Dav, an average value that was calculated for the first time. This makes it possible to perform the image quality adjustment that will not be affected by average values which include temporal degradation and/or the like. Additionally, although, in the above-mentioned embodiment, the density unevenness measurement toner image Gt is formed over a single complete revolution of the photoreceptor drum 2, other than the single complete revolution, it is also possible with one half revolution, etc.

Figure 8A:
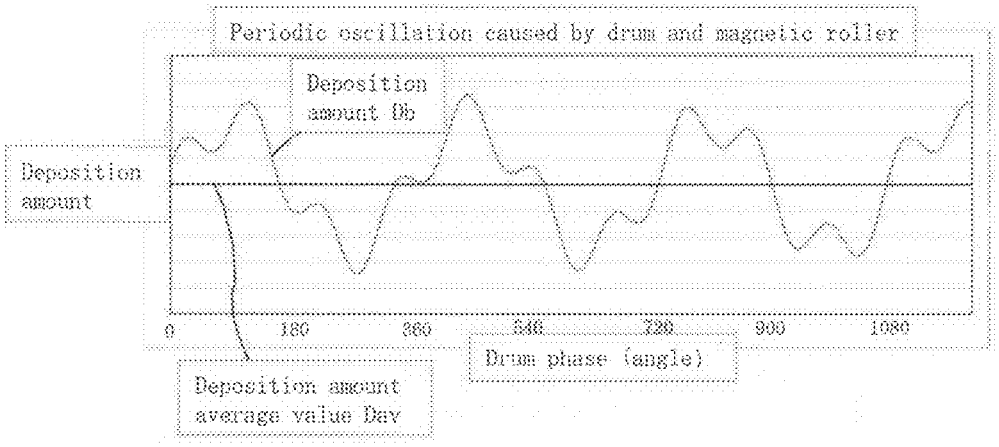
FIG. 8A is a diagram explaining a state of the density unevenness in a case where an effect of an oscillation of a developing roller is also taken into consideration, and is a time chart showing an example of an oscillation (density unevenness) of the toner deposition amount that appears on the photoreceptor drum.
Figure 8B:
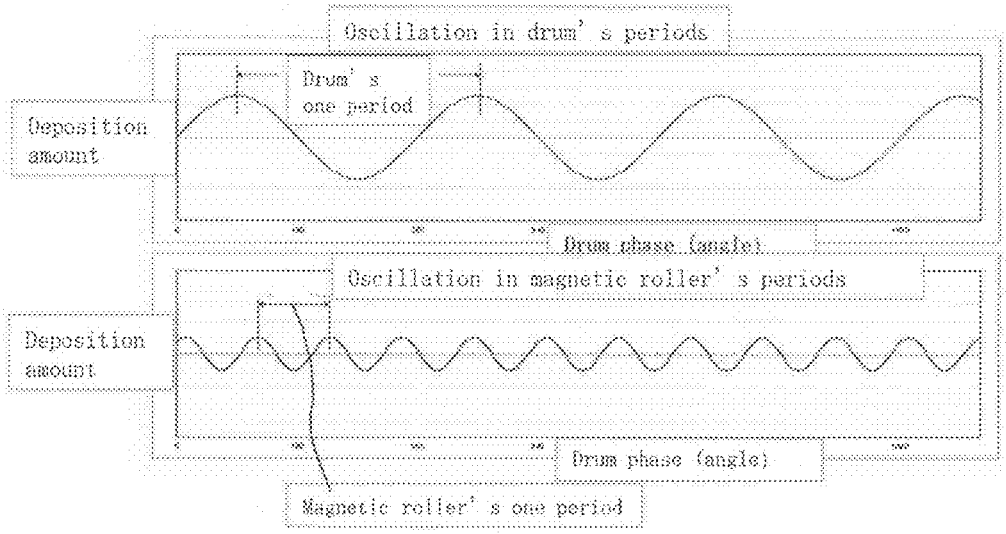
FIG. 8B is a diagram explaining a state of the density unevenness in the case where the effect of the oscillation of the developing roller is also taken into consideration, and is a time chart showing an example of the oscillation that depends on rotational periods of the photoreceptor drum and the developing roller (magnetic roller).

FIGS. 8A, 8B are diagrams explaining a second embodiment. FIGS. 8A, 8B show a case where a cause of the density unevenness occurring in the sub-scanning direction lies with the developing roller (magnetic roller) 41 of the developing unit 4 as well, in addition to the photoreceptor drum 2. Here, as in FIG. 5, the density unevenness is shown exaggeratedly for convenience of description. In a case such as where the revolving shaft of the developing roller 14 is not parallel with the surface of the photoreceptor drum 2, there may arise an oscillation in the performance of supplying the toner onto the photoreceptor drum 2 in the rotational direction (sub-scanning direction) of the developing roller 14, and may thereby cause the occurrence of the density unevenness on the photoreceptor drum 2. In such a case, it is necessary to tackle the density unevenness in phase in a sub-scanning direction synthesized from the photoreceptor drum 2 and the developing roller 14 that revolve synchronously with each other. For example, when the diameter of the photoreceptor drum 2 is 50 mm and the diameter of the developing roller 14 is 30 mm, it is necessary to acquire the density unevenness information for the least common multiple of both of these diameters, that is, 150 mm, which amounts to three complete revolutions of the photoreceptor drum 2. Here, this relationship, in terms of number of revolutions, corresponds to three revolutions of the photoreceptor drum 2 for five revolutions of the developing roller 14. In FIG. 8B, an example of the density unevenness for three complete revolutions of the photoreceptor drum 2 and the density unevenness for five complete revolutions of the developing roller 14 is shown. Combination of both of the density unevenness results in the density unevenness shown in FIG. 8A. In this case, as the rotation sensor 132, a counter that identifies the rotation phase for the three complete revolutions of the photoreceptor drum 2 by counting the reference pulse should be installed.

Moreover, in a case of coping with both of the rotation unevenness of the photoreceptor drum 2 and the developing roller, apart from the above-mentioned embodiment in which the least common multiple is used to set a range of measurement, the undermentioned embodiment may be adopted. For example, an embodiment in which the image formation driving portion 131 drives a means for rotationally driving the photoreceptor drum 2 and a means for rotationally driving the developing roller 14 independently between each other may be adopted. In this case, the control portion 90 perform a control each time the detection is carried out in the image quality adjustment mode so that both the rotation phase of the photoreceptor drum 2 detected by the rotation sensor 132 and the rotation phase of the developing roller 14 detected by a rotation sensor 133 (see FIG. 2) similar to the rotation sensor 132 agree with a phase relationship between the rotation phase of the photoreceptor drum 2 and the rotation phase of the developing roller 14 at the time when the measurement was performed in the density unevenness measurement mode. In this manner, by performing a matching control on the rotation phase of the developing roller 14, it is made possible to perform a phase matching without waiting for the least common multiple times of revolutions to be attained. In this case, although the time needed to perform the image quality adjustment mode increases slightly by an amount of time that is required to perform the rotation phase matching on the developing roller 14, it is conceivable that the increase of time won't barely be an issue, since the developing roller 14 has a smaller diameter compared with the photoreceptor drum 2 (especially, the intermediate transfer belt 21).

Further, instead of the embodiment where the density detection is performed on the intermediate transfer belt 21 side, as a third embodiment, an embodiment where direct density detection is performed with the density sensor 2 disposed at each photoreceptor drum 2 may be acceptable. This makes it possible to perform the process without being affected by the intermediate transfer belt 21.

Additionally, the above-mentioned embodiments can be implemented to each color in the same manner.

Moreover, the above explanations of the embodiments are nothing more than illustrative in any respect, nor should be thought of as restrictive. Scope of the present invention is indicated by claims rather than the above embodiments. Further, it is intended that all changes that are equivalent to a claim in the sense and realm of the doctrine of equivalence be included within the scope of the present invention.

What is claimed is:

1. An image forming apparatus in which a toner image is formed onto a revolving image bearing member, the apparatus comprising:

a density unevenness measurement processing portion that:

detects density of a density unevenness measurement toner image, which has been formed in a rotational direction of the image bearing member, multiple times in the rotational direction, captures in a memory portion detected density information associating thereof with rotation phases of the image bearing member, calculates an average value of the captured density information, and captures in the memory portion density unevennesses, each of which is a ratio or a differential between the captured density information and the average value, for every rotation phase of the rotation phases of the image bearing member; and an image quality adjustment processing portion that detects density of an image quality adjustment toner image, which has been formed at any position in the rotational direction of the image bearing member, in the rotational direction and corrects detected density information based on a density unevenness that is associated with a rotation phase that matches a rotation phase at which density of the image quality adjustment toner image has been detected among the density unevennesses that have been captured in the memory portion by the density unevenness measurement processing portion.

2. The image forming apparatus according to claim 1, wherein the density unevenness measurement toner image is for a single complete revolution of the image bearing member.

3. The image forming apparatus according to claim 1, wherein the density unevenness measurement processing portion, each time on accepting an instruction, performs a measurement operation; and the image quality adjustment processing portion performs the correction based on a differential between the average value obtained by the density unevenness measurement processing portion for the first time and currently measured density information.

4. The image forming apparatus according to claim 1, wherein the image bearing member is removably attached to an apparatus main body; and the density unevenness measurement processing portion performs a measurement operation depending on an occurrence of attachment of the image bearing member.

5. The image forming apparatus according to claim 1, wherein the apparatus includes a developing roller that supplies the image bearing member with toner; and the image quality adjustment processing portion forms the image quality adjustment toner image with a phase relationship between a rotation phase of the image bearing member and a rotation phase of the developing roller being matched to a phase relationship between a rotation phase of the image bearing member and a rotation phase of the developing roller in the density unevenness measurement processing portion.

6. The image forming apparatus according to claim 5, wherein the density unevenness measurement processing portion, in a case where a ratio between number of revolutions of the image bearing member and number of revolutions of the developing roller is expressed by an integer to integer ratio, forms the density unevenness measurement toner image and detects the density thereof for a range of the rotation phase corresponding to number of revolutions that is given by the least common multiple of said both integers.

7. An image quality adjusting method comprising:

a density unevenness measurement step that includes:

forming a density unevenness measurement toner image in a rotational direction of an image bearing member, detecting, multiple times in the rotational direction, density of the density unevenness measurement toner image that has been formed, capturing in a memory portion detected density information associating thereof with rotation phases of the image bearing member, calculating an average value of the captured density information, and capturing in the memory portion density unevennesses, each of which is a ratio or a differential between the captured density information and the average value, for every rotation phase of the rotation phases of the image bearing member; and an image quality adjustment step that includes:

forming an image quality adjustment toner image at any position in the rotational direction of the image bearing member, detecting, in the rotational direction, density of the image quality adjustment toner image that has been formed, and correcting detected density information based on a density unevenness that is associated with a rotation phase that matches a rotation phase at which density of the image quality adjustment toner image has been detected among the density unevennesses that have been captured in the memory portion in the density unevenness measurement step.

* * * * *